US005458071A

United States Patent [19]

Tadmor et al.

[11] Patent Number: 5,458,071

[45] Date of Patent: Oct. 17, 1995

[54] DESTRUCTION OF ROCKET ENGINES

[75] Inventors: Oded Tadmor, Ramat Hasharon; Eitan Hirsch, Netanya, both of Israel

[73] Assignee: Taas-Israel Industries Ltd., Ramat Hasharon, Israel

[21] Appl. No.: 73,757

[22] Filed: Jun. 8, 1993

[30] Foreign Application Priority Data

Jun. 15, 1992 [IL] Israel ..... 102199

[51] Int. Cl.[6] ..... F23G 7/00

[52] U.S. Cl. ..... 110/237; 110/242; 588/202

[58] Field of Search ..... 110/193, 235, 110/236, 237, 242; 60/253; 588/202

*Primary Examiner*—Denise L. Gromada
*Assistant Examiner*—Susanne C. Tinker
*Attorney, Agent, or Firm*—Helfgott & Karas

[57] ABSTRACT

An installation for the destruction of solid fuel rocket engines. The installation comprises a pressure and temperature resistant vessel having a neck portion and a gas chamber portion with heat dissipating means. In operation the rocket engine is gripped in the neck portion and upon ignition of the solid fuel combustion gases are discharged into the gas chamber. Means are provided for the controlled discharge of combustion gases into a gas disposal device.

3 Claims, 1 Drawing Sheet

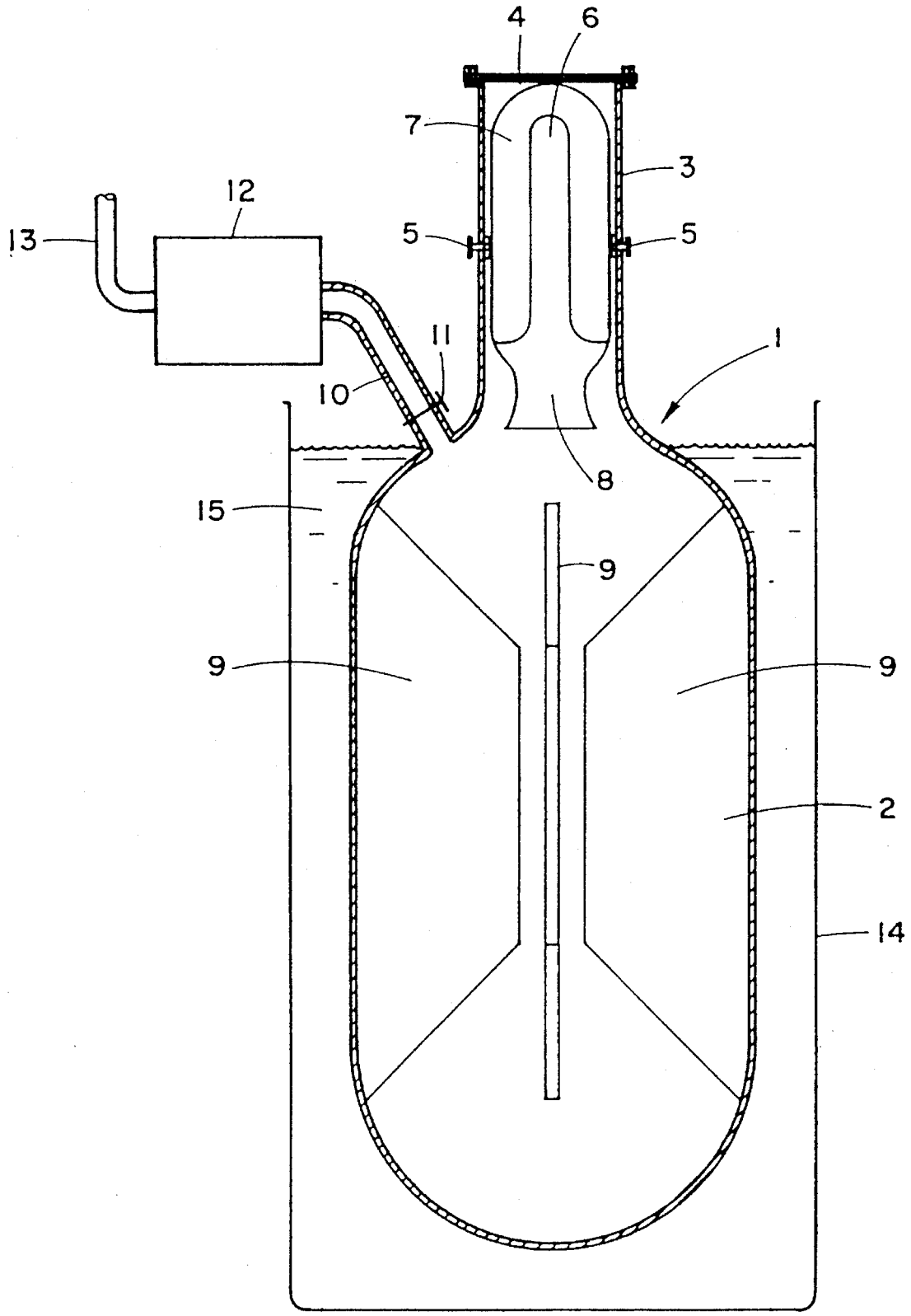
4
6
7
3
12
13
5
5
11
1
10
8
15
9
9
9
2
14

DESTRUCTION OF ROCKET ENGINES

FIELD OF THE INVENTION

The present invention concerns the dismantling of missiles and more specifically the destruction of solid fuel missile rocket engines in which the propellant is of the solid fuel type, by the controlled combustion of such propellant in an environmentally friendly manner.

BACKGROUND OF THE INVENTION

In consequence of past proliferation of war missiles of various types, the ongoing disarmament of such missiles, and notably the destruction of the rocket engines thereof, is rapidly developing into a serious problem. In solid fuel-type rocket engines the propellant is firmly attached to the inner wall of the engine's combustion chamber in a practically unserverable fashion, and can thus only be removed by combustion. According to the state of the art this is done in open air whereby the hazardous and environmentally unfriendly combustion gases are discharged into the atmosphere. Inherently, such open air combustion of solid fuel rocket engines can be done only remote from any habitation, which in itself is a hardship, and even so, there occurs a cumulative pollution of the atmosphere.

Also other types of rocket engines have to be destroyed from time to time, e.g. when faults are detected or when they have reached a prescribed expiry date.

The increasing quantity of rocket engines that have to be destroyed annually rapidly leads to a world-wide pollution problem. In consequence, legislation is developing by which open-air combustion of solid fuel rocket engines is forbidden and there is thus an urgent need for alternative solutions.

It is the object of the present invention to solve the problem by providing an installation for the controlled combustion of the solid fuel in a rocket engine under complete isolation from the atmosphere.

SUMMARY OF THE INVENTION

In accordance with the present invention there is provided an installation for the controlled combustion of solid fuel in a rocket engine having a nozzle and a combustion chamber accommodating said solid fuel, which installation comprises a pressure and heat resistant vessel having a gas chamber capable of holding gases produced by the combustion of said solid fuel, a hermetically sealable neck portion designed to accommodate a rocket engine and fitted with gripper means by which a rocket engine can be held tightly within said neck portion with its nozzle facing said gas chamber, heat dissipating means within said gas chamber, a gas disposal device in association with said gas chamber, and gas discharge means fitted with gas flow control means for conducting combustion gases from said gas chamber to said gas disposal device.

For the gas chamber to be capable of holding the combustion gases its volume must be a large manifold of that of the rocket engine, say 500 to 1000 times larger or even more.

In accordance with one embodiment of the invention, said heat dissipating means within the gas chamber are in the form of a plurality of flat members such as ribs or fins projecting radially from the wall of the gas chamber.

In operation a rocket engine that has to be destroyed is mounted tightly within the neck portion of the vessel with the nozzle facing the gas chamber, whereupon the vessel is hermetically sealed. Upon ignition of the engine the combustion gases are discharged through the engine's nozzle into the gas chamber leading to a temperature and pressure build-up within the chamber. For adequate heat dissipation from within the gas chamber the vessel has to be cooled from the outside, and where the surrounding atmosphere is insufficient for the purpose, cooling means must be provided, e.g. by mounting the vessel within a cooling tank or by fitting it with a cooling jacket.

Preferably an installation according to the invention will comprise temperature and/or pressure gauges whereby the conditions prevailing within the gas chamber can be monitored. Where in the course of operation the pressure or temperature within the gas chamber becomes excessively high, combustion gases may be bled off from the gas chamber in a controlled fashion through the gas discharge means whereby the combustion rate is decreased and the temperature and pressure within the gas chamber are reduced.

The gas disposal device can be of any conventional type which holds back the combustion gases by way of absorption, adsorption or catalytic adsorption so that essentially only an air/steam mixture is discharged to the atmosphere.

DESCRIPTION OF THE DRAWINGS

For better understanding, the invention will now be described, by way of example only, with reference to the annexed drawing which shows schematically, partly in section an installation according to the invention.

DESCRIPTION OF A SPECIFIC EMBODIMENT

The installation according to the invention shown in the drawing comprises a pressure and heat resistant combustion gas vessel 1 having a gas chamber 2 and a neck portion 3 fitted with a lid 4 capable of hermetic sealing, and gripper means 5 for tightly mounting a rocket engine 6 having solid fuel 7 lining its inner wall and a nozzle 8 facing gas chamber 2.

Gas chamber 2 has four radially projecting heat dissipating fins 9 which extend in axial direction such as to minimize the resistance to the combustion gases discharged from nozzle 8.

It should be noted that the vessel 1 is not drawn to scale and that in reality gas chamber 2 is much larger relative to neck portion 3 than shown in the drawing.

Vessel 1 has a gas discharge pipe 10 fitted with gas flow control means 11 and-leading into a gas disposal device 12 of a known type fitted with an exhaust pipe 13 by which an air/steam mixture is discharged to the atmosphere.

As shown, vessel 1 is immersed in a cooling tank 14 holding a body of water 15. Water 15 within the cooling tank 14 may be stagnant or continuously flowing as the circumstances may require and as known per se. Instead of the water tank vessel 1 may be fitted with a cooling jacket.

Vessel 1 is preferably provided with temperature and pressure gauges which are not shown.

In the course of operation, once a rocket engine 6 is mounted in the manner shown in the drawing and lid 4 is tightly secured so as to seal vessel 1 hermetically, the engine is ignited by an electric ignition mechanism not shown and the combustion gases are discharged into gas chamber 2 where a gradual pressure and temperature build-up takes place. The temperature is dissipated by means of the cooling fins 9 via the walls of vessel 1 into the body of cooling water 15. Where there occurs an excessive build-up of pressure and/or temperature, some of the combustion gases may be bled off via a discharge pipe 10 into the gas disposal device 12 by opening the gas control means 11 to a desired extent, whereby the pressure and temperature within gas chamber 2 are reduced and the rate of combustion is slowed down.

When the combustion is completed, all the accumulated combustion gases are exhausted from gas chamber 2 into the gas disposal device 12 and the remaining steam/air mixture is discharged via exhaust pipe 13 into the atmosphere.

I claim:

1. An installation for the controlled combustion of solid fuel in a rocket engine having a nozzle and a combustion chamber accommodating said solid fuel, which installation comprises a pressure and heat resistant vessel having a gas chamber capable of holding gases produced by combustion of said solid fuel, a hermetically sealable neck portion designed to accommodate a rocket engine and fitted with gripper means by which a rocket engine can be held tightly within said neck portion with its nozzle facing said gas chamber, heat dissipating means within said gas chamber, a gas disposal device in association with said gas chamber, and gas discharge means fitted with gas flow control means for conducting combustion gases from said gas chamber to said gas disposal device.

2. An installation according to claim 1, wherein exterior cooling means are provided for cooling said combustion gas holding vessel.

3. An installation according to claim 2, wherein said exterior cooling means is a water tank in which said combustion gas holding vessel is immersed.

* * * * *